US005860902A

United States Patent [19]

Jang et al.

[11] Patent Number: 5,860,902

[45] Date of Patent: Jan. 19, 1999

[54] PAINT ROLLER FRAME WITH AN ADJUSTABLE HANDLE

[76] Inventors: Bor-Zeng Bohr Jang, 2076 S. Evergreen Dr., Auburn, Ala. 36830; Don W. Parker, Rt. 4 Box 37, Enterprise, Ala. 36330

[21] Appl. No.: 599,582

[22] Filed: Feb. 9, 1996

[51] Int. Cl.[6] ..... B05C 17/02

[52] U.S. Cl. ..... 492/13; 16/114 R

[58] Field of Search ..... 492/13; 15/230.11, 15/144.1; 16/114 R, 112

[56] References Cited

U.S. PATENT DOCUMENTS

| | | | |
|---|---|---|---|
| 2,555,226 | 5/1951 | Draugtin | 15/144.1 |
| 2,818,291 | 12/1957 | McCorns | 15/144.1 |
| 3,273,192 | 9/1966 | Mazzella | 15/230.11 |
| 3,329,988 | 7/1967 | Kirschenbaum | 15/144.1 |
| 3,357,035 | 12/1967 | Ficke . | |
| 3,408,676 | 11/1968 | Cayo . | |
| 3,413,043 | 11/1968 | Bertolina | 15/144.1 |
| 3,419,931 | 1/1969 | Willig . | |
| 3,825,970 | 7/1974 | Hanssen | 15/230.11 |
| 3,866,257 | 2/1975 | Cansdale | 15/230.11 |
| 4,038,716 | 8/1977 | Polsfuss | 15/230.11 |
| 4,196,491 | 4/1980 | Baril | 15/230.11 |
| 4,254,529 | 3/1981 | Cooke | 15/230.11 |
| 4,528,714 | 7/1985 | Beck | 15/230.11 |
| 4,897,393 | 1/1990 | Barker | 15/230.11 |
| 5,050,261 | 9/1991 | Hofacker | 15/144 R |
| 5,167,055 | 12/1992 | Stoddart | 29/110.5 |
| 5,207,755 | 5/1993 | Ampian | 15/230.11 |

*Primary Examiner*—David P. Bryant
*Assistant Examiner*—Marc W. Butler

[57] ABSTRACT

An improved paint roller frame that permits switching between two paint rolling directions or between two tilted painting angles. The frame comprises a roller cage assembly, a shaft for receiving the roller cage assembly, and a handle for supporting the shaft. The handle or its extension pole comprises two substantially elongated members being releasably fastened with a fastening means. Each of the mating ends of these two handle members has an oblique end section to which the normal is inclined with respect to the longitudinal axis of the corresponding handle member at an angle of approximately 5 to 45 degrees. The roller handle or its extension pole may optionally have a second set of oblique sections, to which the normal is inclined with respect to the handle axis at an angle of approximately 5 to 45 degrees. The second set of oblique planes are inclined at an angle of approximately 45 to 90 degrees with respect to the first set. One set of the oblique planes can be used for tilted painting angle adjustments while the other for paint rolling direction adjustments.

9 Claims, 12 Drawing Sheets

PAINT ROLLER FRAME WITH AN ADJUSTABLE HANDLE

FIELD OF INVENTION

The present invention relates generally to an improved paint roller frame with an adjustable handle and, in particular, to an improved paint roller handle or its extension pole whose configuration can be readily adjusted to facilitate switching between approximately horizontal and vertical paint rolling, between straight 0° and tilted-angle painting motions, or a combination of both functions.

RELATED ART STATEMENT

A commonly used frame for an un-shielded paint roller is made up of a roller cage assembly, a shaft, and a handle. The shaft is usually a properly bent metallic rod with one end connected to or integral with the roller cage while the other end connected to or partially embedded in a plastic or wood-based handle. Examples can be found in U.S. Pat. Nos. 5,167,055 and 4,897,893 and the patent documents cited therein. The metallic rod is typically bent at two or three locations so that the rod can be considered to consist of three or four segments, each segment being a substantially straight member. The last shaft member is normally connected to a handle in such a fashion that the handle axis is substantially perpendicular to the roller cage axle.

These prior-art rollers can be used to effectively apply paint in a vertical (up and down) direction. In many practical painting situations, however, painting can be best accomplished by rolling in the horizontal (left and right) direction. For instance, when an extension pole is connected to a roller for painting a high location such as a facia, horizontal rolling is more convenient to perform and provides better painting quality than vertical rolling. When roll painting up and down on an upper wall location near the edge of a ceiling, one tends to accidentally paint on the ceiling surface. This undesirable result can be more effectively avoided by rolling the paint applicator horizontally. In these situations, these prior-art rollers cannot be used because the paint roller cage axle is approximately perpendicular to the roller handle. Such a configuration of a roller frame and an optionally connected extension pole will permit up-and-down rolling only. The roller cage axle must be in a parallel orientation with respect to the longitudinal direction of the extension pole, both being in a substantially vertical orientation, in order for the roller to roll horizontally when the extension pole is moved horizontally.

In a prior-art frame (U.S. Pat. No. 3,825,970), a handle is centrally mounted to a spray shield through an adjustable pivot. The axle of this pivot lies substantially parallel to the axle of the cylindrical roller so that the handle and the extension pole possibly connected thereto will always lie substantially perpendicular to said roller axle, thereby permitting only vertical rolling. The paint roller frame disclosed in the U.S. Pat. No. 4,254,529 has a spray shield that is integral with a handle and is without an adjustable handle. The painting direction, therefore, cannot be adjusted in this case.

One embodiment of a recent invention by Jang and Parker (U.S. Pat. No. 5,497,527) contains a paint roller handle that has a threaded or un-threaded hole being approximately transverse to the handle length direction. The handle could also have another threaded or un-threaded hole (the longitudinally elongated hole or end hole) at one end. Both holes may be female threaded to accommodate a male threaded end of an extension pole. Alternatively, both holes may be plain or un-threaded to accommodate a slightly tapered end of an extension pole. The extension pole, once fitted into the transverse hole of the handle, will allow the user to easily roll the roller horizontally. When connected to the end hole of the handle, as in the case of other prior-art rollers, the extension rod will allow the user to move the roller vertically.

A second way of providing a roller for both vertical and horizontal rolling is to have an adjustable pivot, of which the axle is substantially perpendicular to the plane defined by the roller cage axle and the shaft. This adjustable pivot means may be located at the roller extension pole (e.g., U.S. Pat. No. 3,357,035 to Ficke and U.S. Pat. No. 5,050,261 to Hofacker), the roller handle (e.g., U.S. Pat. No. 3,866,257 to Cansdale, and U.S. Pat. No. 5,207,755 to Ampian), or the shaft (e.g., U.S. Pat. No. 3,273,192 to Mazzella, U.S. Pat. No. 3,419,931 to Willing, U.S. Pat. No. 4,038,716 to Polsfuss, U.S. Pat. No. 4,528,714 to Beck, U.S. Pat. No. 4,196,491 to Baril, and U.S. Pat. No. 3,408,676 to Cayo).

These improved rollers do provide convenient adjustments on the painting orientation. However, there are some shortcomings associated with each one of these prior art rollers. For instance, disclosed in U.S. Pat. No. 5,207,755 is a paint roller that contains a sophisticated "universal rotating mechanism" to support the rod to the handle such that the roller cage assembly can be rotated with respect to the handle about three independent axes disposed orthogonally with respect to one another. This configuration represents an over-design for a paint roller and is too complicated to have potential utility value. The delicate rotating mechanism will not function well once a small amount of paint migrates into the gaps between rotating parts.

In most of the roller frames specified in the above-cited patents, the pivot means to connect two shaft or handle segments together is characterized by requiring that each of the two mating ends be provided a disc, being connected to or integral with the corresponding segment. Preferably, on one face of one end disc is provided a circular row of radial serrations. Projecting from the serrated face of the disc is a threaded stud disposed at the center of the disc. The mating disc is provided with a like row of radial serrations and a central opening to receive the threaded stud. When the two mating discs are brought closer with the serrations interengaging, the two discs are held locked together by a wing nut on the stud (e.g., in U.S. Pat. No. 3,273,192). Such an end disc represents a weak link (a potential point of breakage) in the whole shaft-handle structure. A simpler design to eliminate the two mating end discs will lead to a more structurally sound paint roller handle or extension pole. A simpler design would also translates into a lower manufacturing cost. In other cases (e.g., U.S. Pat. No. 3,419,931 to Willing) the fastening mechanism for connecting two shaft segments is composed of many small parts of intricate shape and therefore is not convenient to use.

OBJECTS AND SUMMARY OF THE INVENTION

It is an object of the present invention to provide a paint-applying roller frame, shielded or unshielded, with a relatively simple yet structurally sound handle configuration that can be easily adjusted to change the rolling direction or painting angle.

It is another object of the present invention to provide a paint-applying roller frame with a handle configuration that can be adjusted to change the rolling direction and if fitted with an extension pole at one end of the handle, can facilitate horizontal painting on a high location.

It is yet another object of the present invention to provide a paint-applying roller frame with a handle configuration that can be adjusted to change both the painting angle (permitting switching between straight 0° painting and tilted-angle painting) and the painting orientation (permitting switching between vertical and horizontal rolling).

It is still another object of the present invention to provide a paint roller handle extension pole that can be adjusted to change the rolling direction (to facilitate horizontal painting on a high location), or to simply provide a more convenient tilted angle for regular vertical rolling, or to achieve both functions.

One preferred embodiment of the present invention is a paint roller frame comprising an un-shielded roller cage assembly, a supporting shaft, and a roller handle for gripping and for adjusting painting direction. The shaft comprises three or four substantially elongated members or segments, which are connected together through integral bends or a combination of bends and fastening means. One end of the first shaft segment is normally integral with the axle of the roller cage assembly, but these two portions (cage assembly and the first shaft segment) may be connected through a fastening means. The other end of the shaft segment is connected to one end of the second segment, commonly referred to as the carrier segment. The other end of the carrier segment is then connected to (through a bend or fastening means) one end of the third segment (and then similarly connected to a fourth segment if there are four shaft segments). The final segment (the third in a 3-segment shaft or the fourth in a 4-segment shaft) is commonly referred to as the shank segment, which is in turn connected to the roller handle.

As a preferred embodiment, the shaft is one integral piece of rod with two or three bends to change rod extending directions (shaft segments not being separated and requiring no fastening means to link them up) and that the shank segment is connected to one substantially elongated member (the first handle member) of a two-member handle, schematically shown in FIG. 1. The two handle members are connected by a releasable fastening means through two oblique sections, AB and A'B', where AB represents the end section of the first handle member while A'B' that of the second handle member. To better understand the situation, one may vision that these two oblique sections were created by making a cut through a cylindrical rod at an angle of 45° with respect to the elongate axis of this rod. However, in actual practice, one may choose to fabricate these two handle members separately. The fastening means (e.g., a boltnut combination) will have its bolt going through approximately the geometric center of each oblique sectional plane. The normal to the two sections is inclined with respect to the handle axis at an angle of approximately 45 degrees. This normal also lies approximately on the geometric plane (hereinafter referred to as the primary plane) constituted by the roller cage axle, the shaft and shank, and the longitudinal axis of the first handle member. In their normal positions (with A matching A' while B matching B', shown in FIG. 1*a*), the two handle members form a substantially straight line which is approximately perpendicular to the roller cage axle. Such a configuration provides the usual up-and-down rolling motion (illustrated schematically in FIG. 3*a*). If now the fastening means is loosened to permit rotation around the bolt axis of section A'B' with respect to AB by 180 degrees (shown in FIG. 1*b*), the two handle members would be substantially perpendicular to each other. The second handle member, which is to be connected to an extension pole, would now be substantially parallel to the roller cage axle. This configuration would facilitate horizontal paint rolling (schematically illustrated in FIG. 3*b*).

It is essential that, in its alternate position (FIG. 1*b*), the longitudinal axis of the second handle member lie substantially in the primary plane, or parallel to it, to permit horizontal paint rolling. If instead the second handle member and its attendant extension pole are oriented off the primary plane (e.g., if the roller cage axle pointing normal to the paper), the frame would again permit vertical paint rolling only (FIG. 3*c*). In order to allow for horizontal rolling, it is therefore imperative that the normal to the two oblique planes lie substantially on the same plane (the primary plane) as the roller cage axle, the shaft, and the first handle member.

In another preferred embodiment, the normal to the two oblique section planes is inclined with respect to the handle axis at an angle of approximately 22.5 degrees. Such an configuration permits a choice between the regular vertical rolling (FIG. 2*a*) and 45°-directional paint rolling (schematically shown in FIG. 2*b*). However, as shown in FIG. 3*d*, this roller can also be used for horizontal rolling at a tilted angle. Any angle between approximately 5° and 45° can be utilized to produce paint rollers for meeting special painting needs. In contrast to the roller shown in FIGS. 2*a* and *b* designed for meeting vertical and horizontal rolling needs, a roller may be designed for tilted-angle but vertical paint rolling provided that the normal to the oblique planes is inclined off the primary plane and, therefore, the roller does not lend itself for horizontal rolling.

It may be noted that such a switching mechanism is not necessarily located at the handle of the roller. Many locations of the shaft (e.g., the shank segment) can be designed to have such a mechanism to permit painting in different directions. However, the handle is preferred over the shaft because normally the shaft diameter of an un-shielded roller is too small to have oblique sections of a sufficient area for accommodating a fastening means.

Optionally, the surface profile of the two mating end sections can be such that one surface contains a circular row of radial serrations. Retreating from the serrated face of each section and going into the bulk of the handle segment (at an angle of approximately 90 degrees with respect to the section surface) is a threaded or un-threaded hole disposed at the center of the section. The mating surface is provided with a like row of radial serrations and also a central opening to receive a threaded rod or un-threaded pin. When the two mating surfaces are brought closer with the serrations interengaging, the two handle members are held locked together by a nut on the pin.

Another preferred embodiment of the present invention is a shielded paint roller frame (FIGS. 4*a* and 4*b*) comprising, in combination, an integral spray shield with frame means to releasably retain or suspend cylindrical paint-applying rollers therein, an adjustable pivot being retained by a supporting means (e.g., a bracket) preferably centrally mounted on the spray shield, and a substantially elongated roller handle. The integral frame and shield structure contains a generally semi-cylindrical casing shell or enclosure having a pair of end plates and forming a substantial portion of the frame means, plus means for retaining a roller-receiving end cup therewithin for releasable roller retention. The end cups retain the paint-applying roller with its end or edge closely adjacent the end plate. A pivot-supporting means such as a bracket is mounted on the back surface of, being preferably integral with, the casing shell preferably near or at the geometric center of the shell. The bracket is releasably connected through fastening means to the roller handle. The handle again consists of two substantially elongated members, which are connected by a releasable fastening means through two oblique sections of the two handle members. The normal to the two sectional planes is inclined with respect to the handle axis at an angle of approximately 45 degrees. In their normal positions, the two handle members form a substantially straight line which is approximately perpendicular to the roller cage axle (FIGS. 4*a* and 4*b*). Such a configuration provides the usual up-and-down rolling motion. If now the fastening means is loosened to permit rotation of one section with respect to the other by 180 degrees (FIGS. 4*c* and 4*d*), the two members would be substantially perpendicular to each other. The second handle member, which is to be connected to an extension pole, would now be substantially parallel to the roller cage axle. This configuration would facilitate horizontal paint rolling.

Again, it is essential that, in its alternate position (similar to that in FIG. 1*b*), the longitudinal axis of the second handle member lie substantially parallel to or in the primary plane to permit horizontal paint rolling. If the normal to the two oblique sections is inclined with respect to the handle axis at an angle of approximately 22.5 degrees, the configuration will permit a choice between vertical and 45°-directional paint. Other angles between approximately 5° and 45° can also be utilized to produce paint rollers for meeting special painting needs. The distal end of the second handle member optionally has a substantially elongated bore, threaded or un-threaded, to accommodate an extension pole.

Another preferred embodiment of the present invention is to have those two oblique sections being located specifically on the extension pole, rather than on the roller handle. Switching between horizontal and vertical rolling can be accomplished by such a design when this new extension pole is properly connected to an existing paint roller. In this case, the normal to the oblique sectional plane must lie substantially in the primary plane constituted by the roller cage axle, the shaft, and the handle.

In some painting situations, it may be convenient to have the roller tilted with respect to the handle or extension rod at an angle (e.g., approximately 45° as schematically shown in FIG. 3*f*). In this case, the normal to the oblique sectional plane will be off the primary plane by a small angle (e.g., 22.5° for the situation in FIG. 3*f*). Such a configuration, although not designed for permitting horizontal paint rolling, may be desirable for painting on a hard-to-reach surface (e.g., a recessed surface). Switching between a normal straight 0° angle and a tilted angle paint rolling can be accomplished by the presently invented roller handle or extension pole by simply loosening and tightening the releasable fastening mechanism.

In yet another preferred embodiment, two sets of oblique planes will be made on a roller handle or preferably on an extension pole; one set being used for facilitating switching between horizontal and vertical paint rolling while the other set for switching between straight 0°-angled and tilted paint rolling. Such an extension pole will make an existing paint roller much more versatile. If the two sets of oblique sections are created on a paint roller handle, this new design will permit various painting tasks to be readily accomplished with an existing extension pole (so that such a traditional pole will not become obsolete). A preferred configuration will comprise a set of oblique sections at an angle of approximately 22.5° or less with respect to the longitudinal axis of the handle or extension pole for tilting angle adjustments, and a second set of oblique sections at an angle of approximately 22.5° to 45° for painting direction adjustments between vertical and horizontal rolling.

BRIEF DESCRIPTION OF THE DRAWINGS

FIG. 1 shows the schematic of an improved paint roller comprising a roller cage assembly (prior art), a supporting shaft, and an adjustable handle having two mating oblique sections releasably tightened by a simple bolt and nut combination.

FIG. 2 FIG. 2*a* and FIG. 2*b* show the schematic of another paint roller in which the normal to the oblique sectional plane is inclined with respect to the longitudinal axis of the handle at an angle of approximately 22.5°. FIG. 2*a* shows the paint roller in its conventional orientation for vertical rolling. FIG. 2*b* shows the same roller in its new orientation for 45°-directional or horizontal rolling.

FIG. 3 shows several desirable painting situations.

FIG. 4 FIGS. 4*a*–4*d* show an improved shielded paint roller in which the pivot-supporting means on the back surface of the shield provides tilting adjustments while the oblique sectional planes on the handle provide rolling direction adjustments. FIG. 4*a* shows the top view of such a roller in its conventional orientation for vertical rolling. FIG. 4*b* shows the side view of the roller in FIG. 4*a*. FIG. 4*c* shows the top view of the same roller in an orientation for horizontal rolling. FIG. 4*d* shows the side view of the same roller as in FIG. 4*d*.

LIST OF DRAWING REFERENCE NUMERALS

Figure 1A:
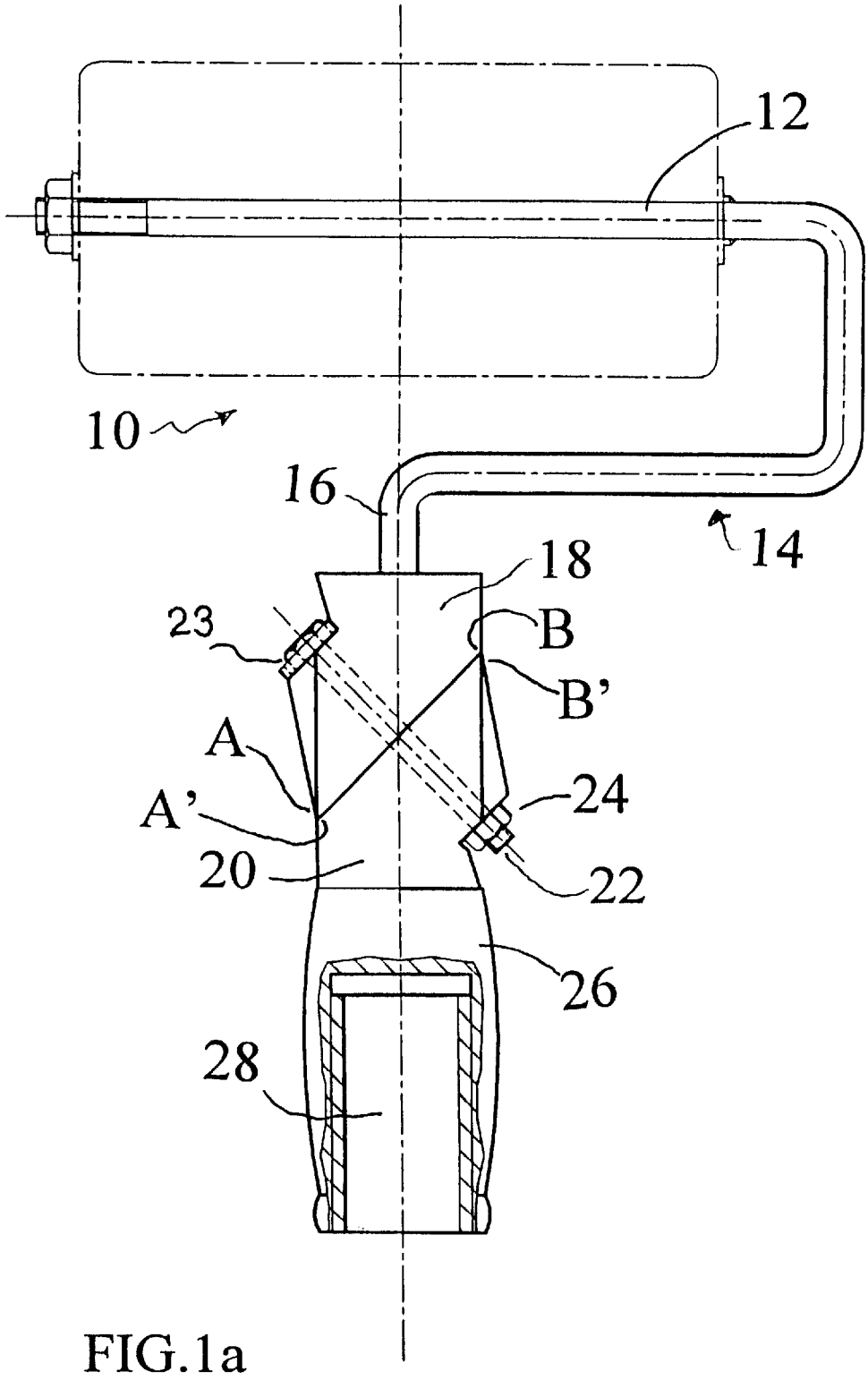
FIG. 1*a* shows the paint roller in its conventional orientation for vertical rolling.

10 An unshielded paint roller (prior art)
12 The axle of a roller cage assembly; a part of a frame shaft
14 A paint roller shaft
16 The shank portion of a shaft, to be connected to the first handle segment
18 The first handle segment (first handle member)
20 The second handle member
AB The oblique end section of the first handle member 18
A'B' The oblique end section of the second handle member 20
22 The bolt of a releasable fastening means
23 The knurled cap portion of the bolt 22
24 The nut of a releasable fastening means
26 The gripping portion of a roller handle
28 An optional elongated bore to accommodate an extension pole
32 The first segment of another roller handle
34 The second segment of this roller handle
36 The bolt of a fastening means whose longitudinal axis is approximately parallel to the normal to the end oblique planes 38 and 40
38 The oblique end section of first handle segment 32
40 The corresponding oblique end section of second handle segment 34
42 The shank being colmected to the first handle segment
44 The first handle segment (first handle member) of a three-member handle
46 The second handle member of a three-member handle
48 The third handle member of a three-member handle
50 The oblique end section at the second end of the first handle member 44
51 The oblique end section at the proximal end of the second handle member 46
52 The oblique end section at the distal end of the second handle member 46
53 The oblique end section at the proximal end of the third handle member 48
54 The first releasable fastening means for connecting the first and second handle members
56 The second releasable fastening means for connecting the second and third handle members
108 A cylindrical paint-applying roller (prior art)
110 An integral frame and shield means (prior art)
111 A casing means
111A A generally semi-circular shell portion of the casing means 111
112 and 113 The two end plates of 111A
114—114 Axially aligned bores in end plates 112 and 113 for releasable roller retention
116,117 A pair of symmetrically disposed ears secured to 111A to support the fastening means between the casing and the roller handle
118,119 Bolt and nut as an example of a releasable fastening means connecting the casing 111 and the roller handle
120 The knurled cap portion of the bolt 118
123 The head end 123 of the first handle segment 124
123A, 123B The two arms of 123, having aligned bores to receive the shank of bolt 118
124 The first handle segment
126 The second handle segment
128 or CD The oblique section at the tail (distal) end of first handle segment 122
129 or C'D' The corresponding end obligation of second handle segment 126
132 An example of a releasable fastening means (bolt and nut)
140 The optional elongate bore to accept an extension pole
150 The first segment of a two-segment extension pole
152 The handle of a roller
154 The oblique end section of first extension pole segment 150
156 The second segment of the extension pole
158 The oblique end section of second extension pole segment 156
160 The fastening means (an example being a bolt-nut combination) between two pole segments
162 The axle of a roller cage assembly, the axle being shown to be integral with the handle frame shaft 164
164 The shaft of a roller frame

DETAILED DESCRIPTION OF PREFERRED EMBODIMENTS

Figure 1B:
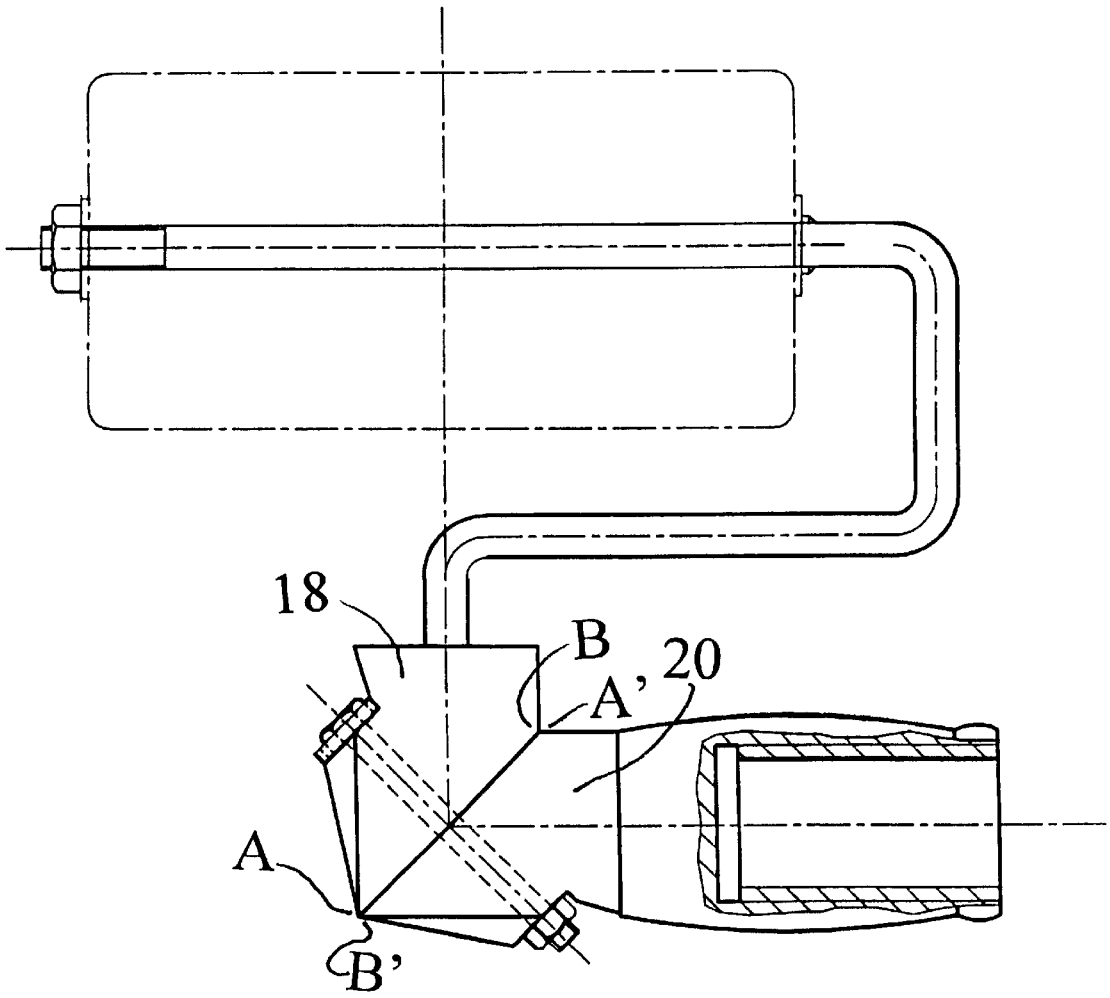
FIG. 1*b* shows the same roller in its new orientation for horizontal rolling.

Preferred embodiments of the present invention may be best illustrated by referring to the attached figures. Shown in FIG. 1 is the schematic of a paint roller frame comprising a roller cage assembly 10 (prior art) and its axle 12, a supporting shaft 14 with the shank portion 16, and a two-member handle. The two substantially elongated members of the handle, 18, 20 are connected by a releasable fastening means (a bolt 22 and nut 24 combination is indicated in FIG. 1 as one example of fastening means) through two oblique sections, AB and A'B', of the two handle members. The bolt 22 is also provided with a knurled cap portion 23. In this figure, AB represents the end sectional plane of the first handle member 18 while A'B' that of the second handle member 20. As stated earlier, one may vision that these two oblique sections were created by making a cut through a cylindrical rod at an angle of 45° with respect to the longitudinal axis of this rod with the understanding that, in actual practice, one may choose to fabricate these two handle members separately, for instance, by plastics molding techniques. The fastening means will have its bolt going through approximately the geometric center of each oblique sectional plane. The normal to the two sections is inclined with respect to the handle axis at an angle of approximately 45 degrees. This normal also lies approximately on the geometric plane (the primary plane) previously defined as the geometric plane constituted by the roller cage axle 12, the shaft 14 and its shank 16, and the longitudinal axis of the first handle member.

Figure 3A:
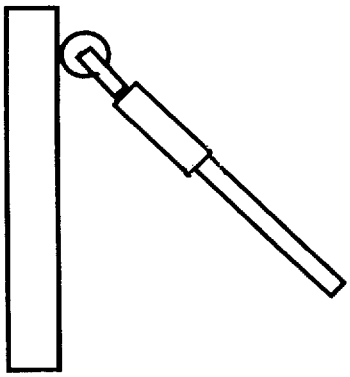
FIG. 3*a*: straight 0°-tilted, up-and-down (vertical) rolling.
Figure 3B:
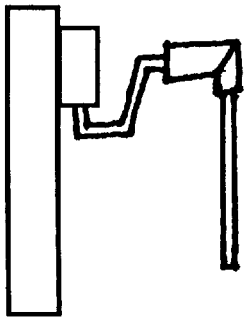
FIG. 3*b*: straight 0°-tilted, left-and-right (horizontal) rolling (e.g., on a horizontal facia)

In the normal position, where A matches A' while B matches B', the two handle members form a substantially straight line which is approximately perpendicular to the roller cage axle 12. Such a configuration provides the usual up-and-down or vertical rolling motion (illustrated schematically in FIG. 3*a*). If now the fastening means is loosened so that one can swing section A'B' around the bolt axis by 180 degrees (shown in FIG. 1*b*), the two handle members 18, 20 would be substantially perpendicular to each other with A matching B' while B matching A'. The second handle member having a bore 28 at its distal end portion 26, which is to be connected to an extension pole, would now be substantially parallel to the roller cage axle. This configuration would facilitate horizontal paint rolling (schematically illustrated in FIG. 3*b*).

Figure 3C:
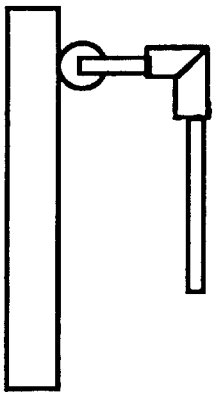
FIG. 3*c*: 90°-tilted (useful on a recessed surface), vertical rolling.

In its alternate position (FIG. 1*b*), the axis of the second handle member 20 must lie substantially in the primary plane, or parallel to it, to permit horizontal paint rolling. This is made possible by requiring that the normal to the oblique sectional plane lie approximately on the primary plane. Otherwise, if the second handle member and its attendant extension pole are oriented off the primary plane, due to the oblique plane normal being off the primary plane, or even perpendicular to the primary plane (e.g., where the roller cage axle 12 pointing normal to the paper), the roller would permit only vertical paint rolling (FIG. 3*c*), but at a tilted angle. A tilted angle roller may prove useful for painting on a grooved or recessed surface.

Figure 2A:
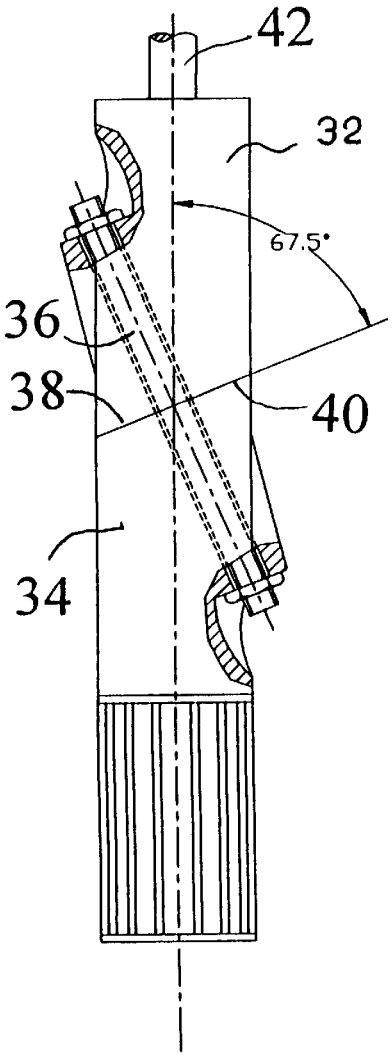
Figure 2B:
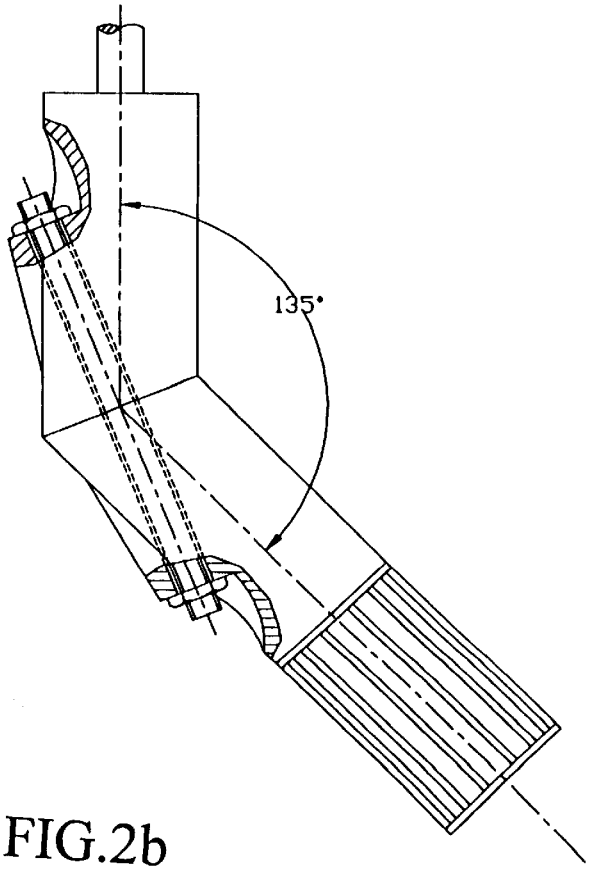
Figure 3D:
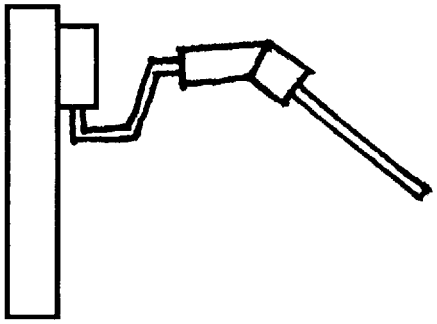
FIG. 3*d*: 45°-tilted, horizontal rolling.

As shown in FIG. 2*a*, if the normal to the two oblique sections is inclined with respect to the handle axis at an angle of approximately 22.5°, then the angle between each oblique sectional plane and the handle axis would be 67.5°. In this diagram, the first handle member 32 has an end oblique section 38 to which the normal lies substantially parallel to the axis of a bolt 36. The proximal end of the second handle member 34 has an end oblique section 40, which well matches its corresponding section 38. If the handle shown in FIG. 2*a* is connected through the shank 42 to a roller cage assembly having its axle approximately perpendicular to the longitudinal axis of the first handle member 32, the roller frame would be in its normal orientation for regular vertical rolling. Further, if the normal to the oblique sectional plane 38 lies approximately on the primary plane defined by the roller axle and the axis of the second handle member, then the roller frame when in its new orientation (FIG. 2*b*) would permit 45°-tilted, horizontal rolling (FIG. 3*d*). Switching between the regular vertical rolling and 45°-tilted horizontal rolling can be effected by loosening the bolt and nut and swinging the second handle member 34 with respect to the first member 32 by 180° (around the bolt 36).

Figure 3F:
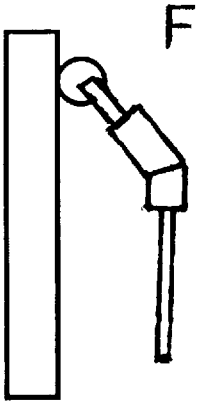
FIG. 3*f*:: 45°-tilted, vertical rolling (particularly useful on a recessed surface).

In contrast, if the normal to the oblique sectional plane 38 lies off the primary plane; for instance, with the roller cage axle lying perpendicular to the paper (with reference to FIG. 2*a*), the frame in its new orientation (FIG. 2*b*) would allow for tilted-angle vertical rolling (FIG. 3*f*), but not horizontal rolling. Any angle ranging from approximately 5° to 45° can be utilized to produce paint rollers for meeting special painting needs. We wish to again point out that the oblique sections do not have to be located at the handle of the roller. Many locations of the shaft or the extension pole (which may be considered as an extension of the handle) can be designed to have such a switching mechanism to permit painting in different directions.

Figure 2C:
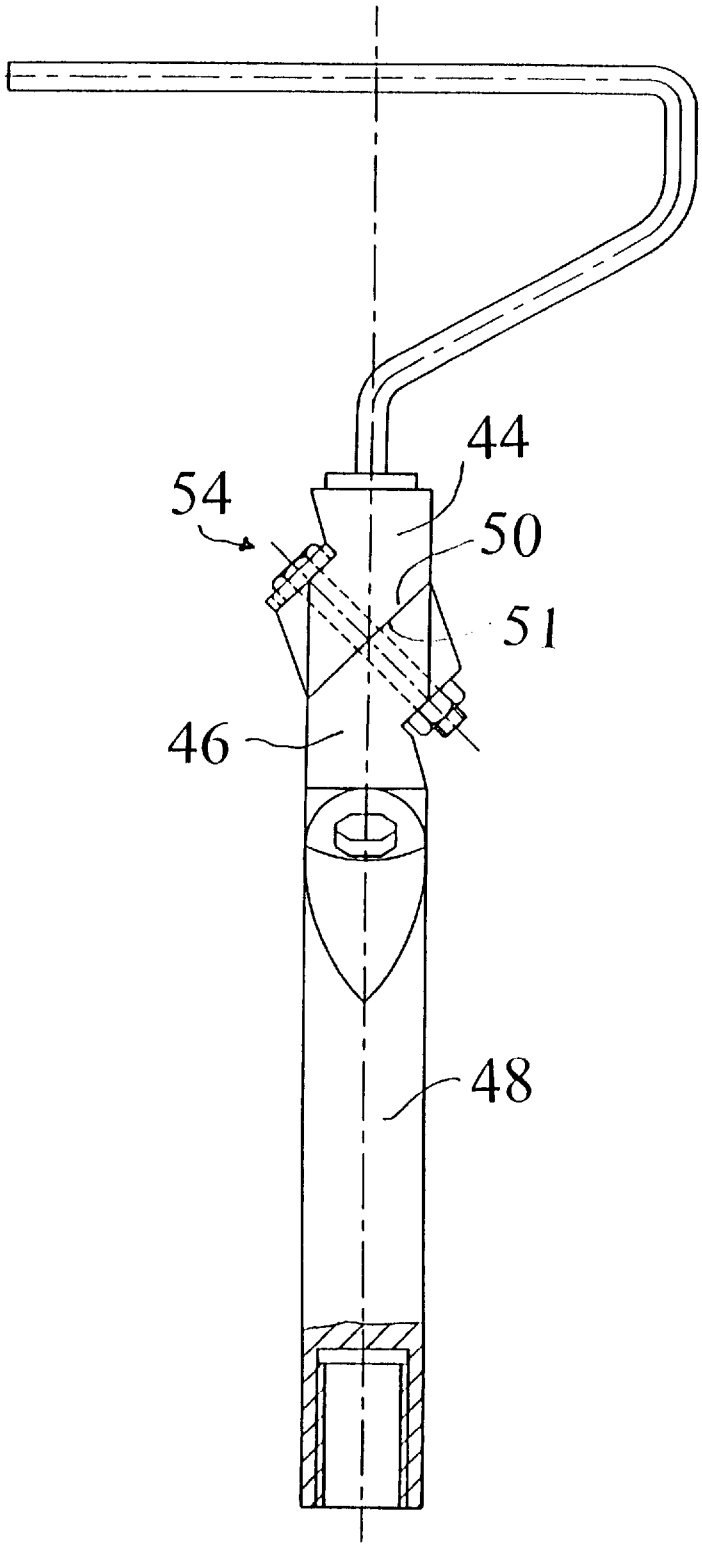
FIG. 2*c* and FIG. 2*d* show the front view and side view, respectively, of yet another improved paint roller wherein the handle is comprised of three substantially elongated members providing two sets of mating oblique end sections which are connected by two releasable fastening means. One set of mating oblique end sections provides the tilted painting angle adjustability while the other set the painting direction adjustability.
Figure 2D:
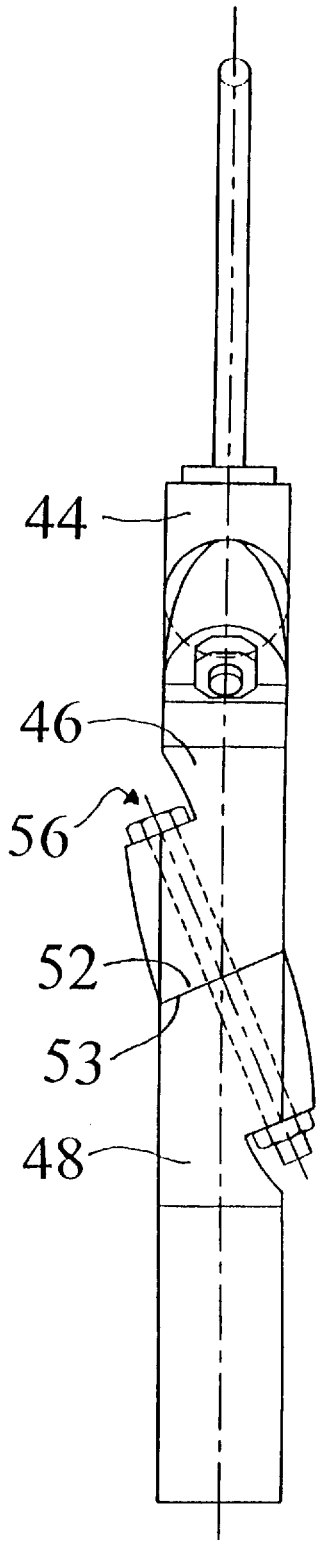

FIGS. 2*c* and 2*d* show the front view and the side view, respectively, of a roller frame containing a handle which is comprised of three substantially elongated members 44, 46, 48. The first handle member 44, having an end oblique section 50, is connected to the second handle member 46, having a corresponding end oblique section 51, through a releasable fastening means 54. This set of oblique end sections 50, 51 and its attendant fastening means 54 are employed for adjustment of the paint rolling direction. The normal to the oblique end section in this example lies approximately on the geometric plane (the primary plane) defined as the geometric plane constituted by the roller cage axle, the shaft and its shank, and the longitudinal axis of the first handle member. This is similar to the situation depicted in FIG. 1. The second and third handle members 46, 48, with corresponding end sections 52, 53, are connected through a second releasable fastening means 56. The normal to the oblique section 53 lies off the primary plane (shown to be advantageously inclined at an angle of approximately 22.5°). Such a combination of oblique end sections and a releasable fastening means is designed for adjustment of the tilted painting angle. The roller handle containing such two sets of mating oblique end sections provide adjustability for both paint rolling direction and tilted painting angle.

Yet another preferred embodiment of the present invention is related to an improved shielded paint roller (FIGS. 4*a*–4*d*). The basic construction of this roller may be chosen to be similar to any of the prior-art shielded rollers, e.g., that disclosed in U.S. Pat. No. 3,825,970 (Hansen, 1974), with the exception that the roller handle now has two substantially elongated members with mating oblique sections 128 (CD) and 129 (C'D') connected through a releasable fastening means 132 to permit rolling direction adjustments. The roller device comprises a cylindrical paint-applying roller 108 (prior art), an integral frame and shield means 110 (prior art) for releasable working retention of the paint-applying roller, and a handle with two members 124, 126. The integral frame and shield means 110 includes a casing means 111 comprising a generally semi-circular shell portion 111A having a pair of generally semi-circular end plates 112 and 113 at each end thereof. The end plates 112 and 113 have axially aligned bores formed therein, such as at 114—114 for releasable roller retention. The back, or outer peripheral portion, of shell 111A has a pair of symmetrically disposed ears 116, 117 secured thereto. These ears have aligned bores formed therein to receive the shank of bolt 118, which is provided with a nut element 119 and a knurled cap portion 120. These ears along with the bolt and nut elements are used to accommodate adjustable locking of tiltable handle 122. The longitudinal axis of the bolt 118 lies substantially parallel to 114—114 which practically defines the axle of the paint-applying roller 108.

Figure 4A:
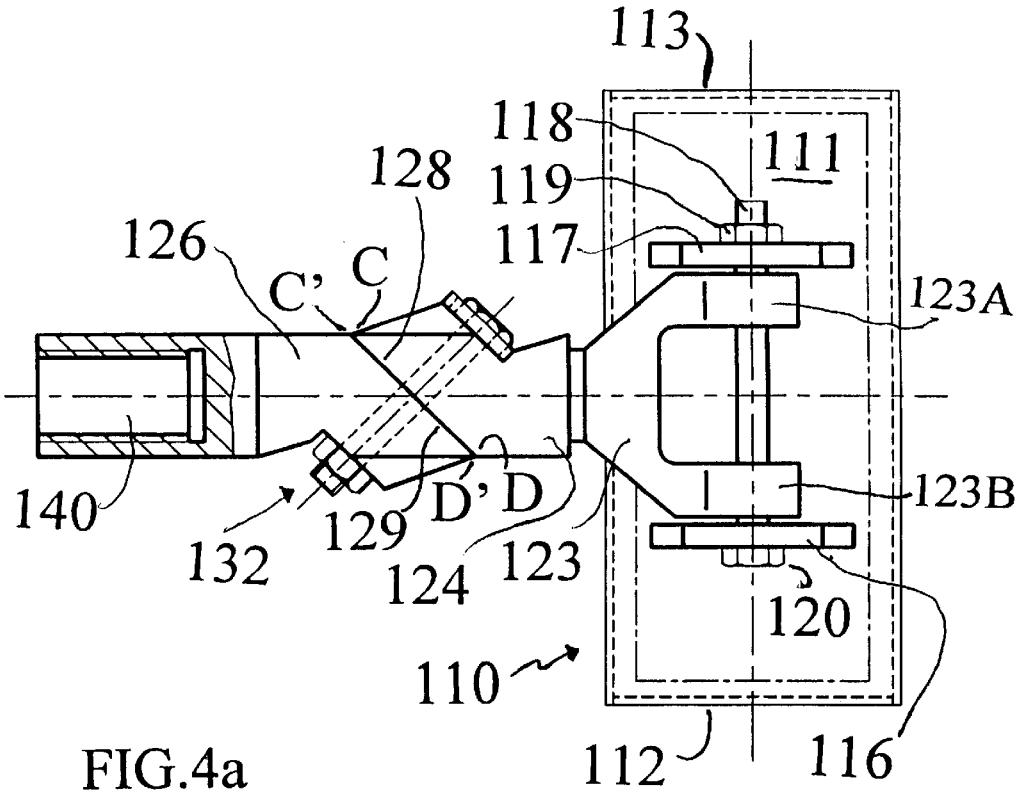
Figure 4B:
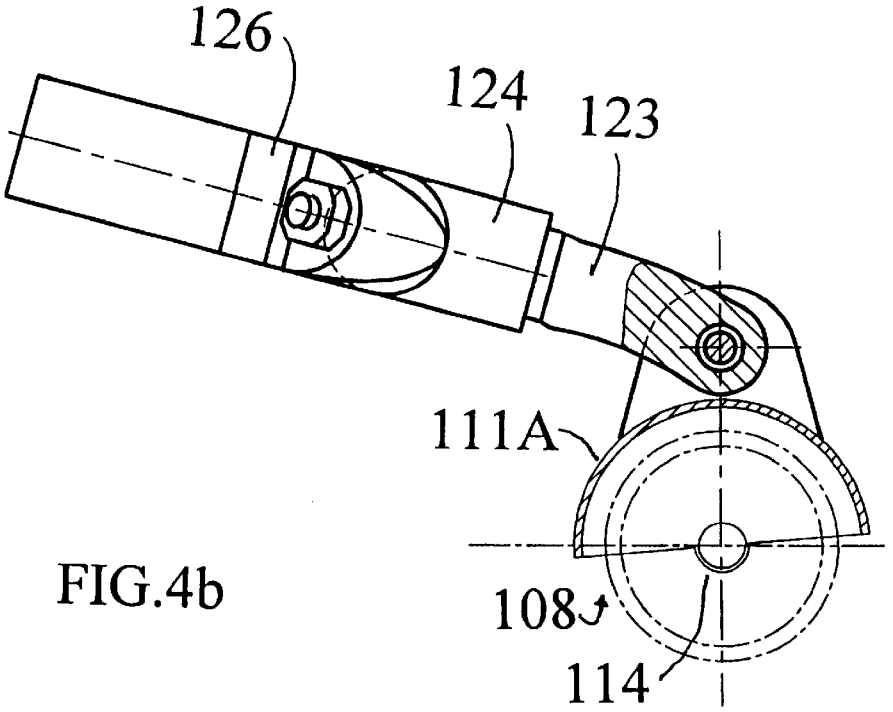
Figure 4C:
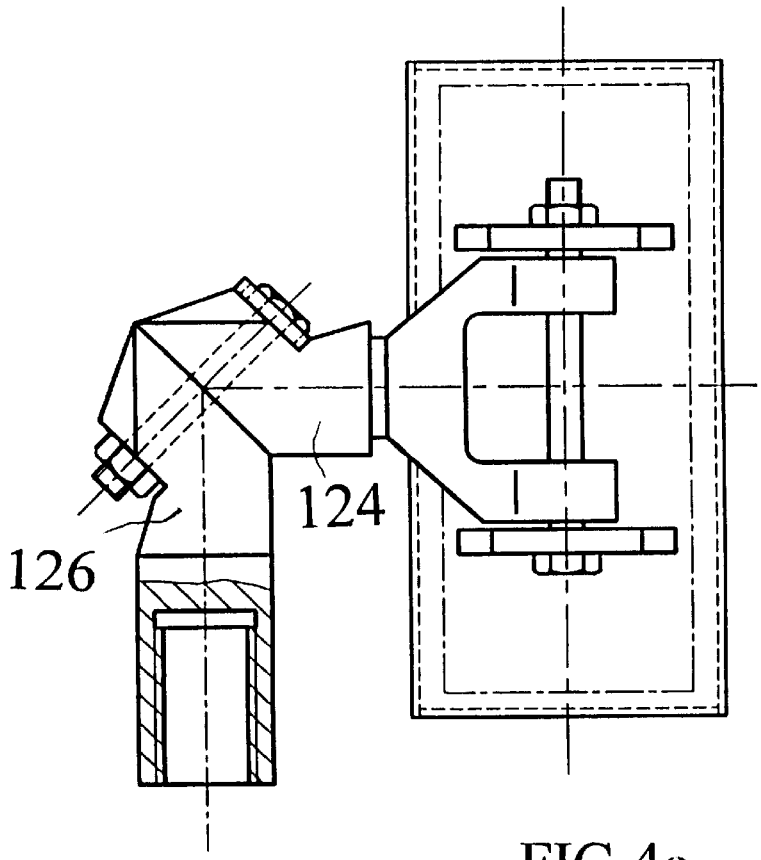
Figure 4D:
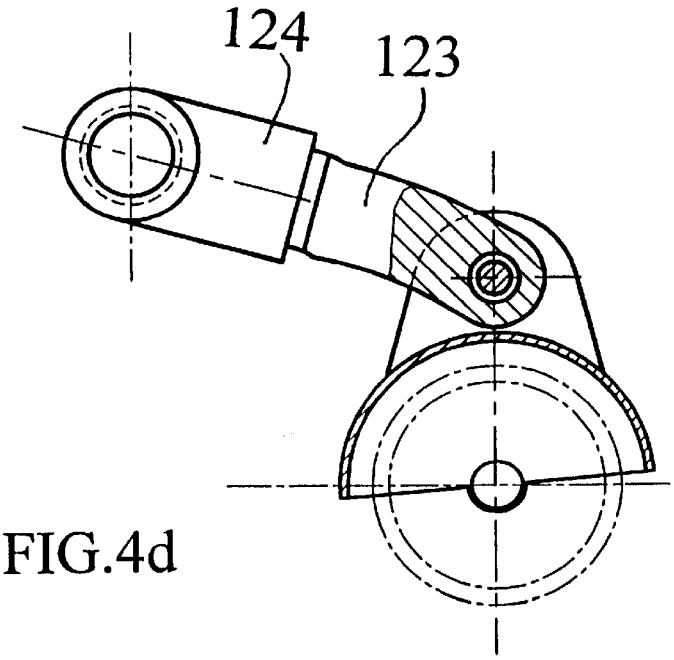

The first handle member 124 is provided with a head end 123 having two arms 123A and 123B which have aligned bores formed therein to receive the shank of bolt 118. The handle member 124 is also provided with a distal end having an oblique section 128 to which the normal is inclined at an angle of approximately 5° to approximately 45°(shown to be 45° in FIG. 4 as an example) with respect to the longitudinal axis of the first handle member 124. The second handle member 126 is provided with a proximal end with an oblique section 129 corresponding to 128. The two sections 128 and 129 are similar in shape, orientational angle, and dimensions and are fitted with a releasable fastening means, which is shown as an example to be a bolt-nut combination 132 in FIG. 4. The normal to the two oblique sections lies substantially on the plane defined by the longitudinal axis of the bolt 118 and the longitudinal axis of the handle member 124. In its conventional orientation as shown in FIG. 4*a* and 4*b*, the two oblique sections are fastened with point C and point D of section 128 matching point C' and D', respectively, of section 129. By loosening the bolt-nut combination 132, swinging the second handle member 126 around the bolt by approximately 180°, and re-tightening the bolt-nut 132 one can achieve a relative orientation of approximately 90° between the two handle members 124, 126, as shown in FIGS. 4*c* and 4*d*. In this situation, the axis of the second handle member 126 is approximately parallel to the axle of the paint-applying roller 108. Such a configuration will permit horizontal paint rolling. The distal end of handle member 126 optionally has a bore 140, preferably threaded, to receive an extension pole if desired.

Figure 4E:
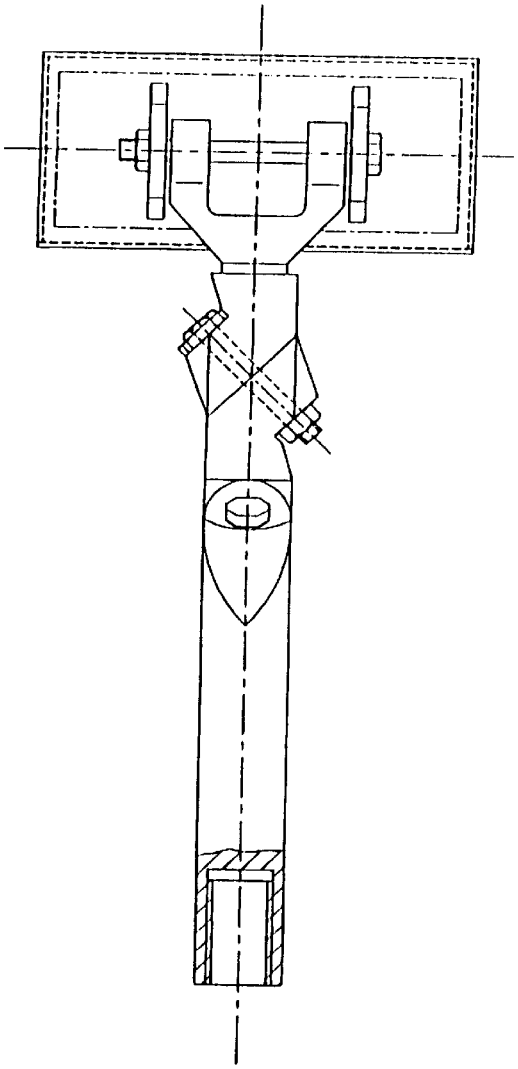
FIG. 4*e* and FIG. 4*f* show the front view and side view, respectively, of another improved shielded paint roller wherein the handle is comprised of three substantially elongated members providing two sets of mating oblique end sections which are connected by two releasable fastening means. One set of mating oblique end sections provides added tilted painting angle adjustability while the other set painting direction adjustability.
Figure 4F:
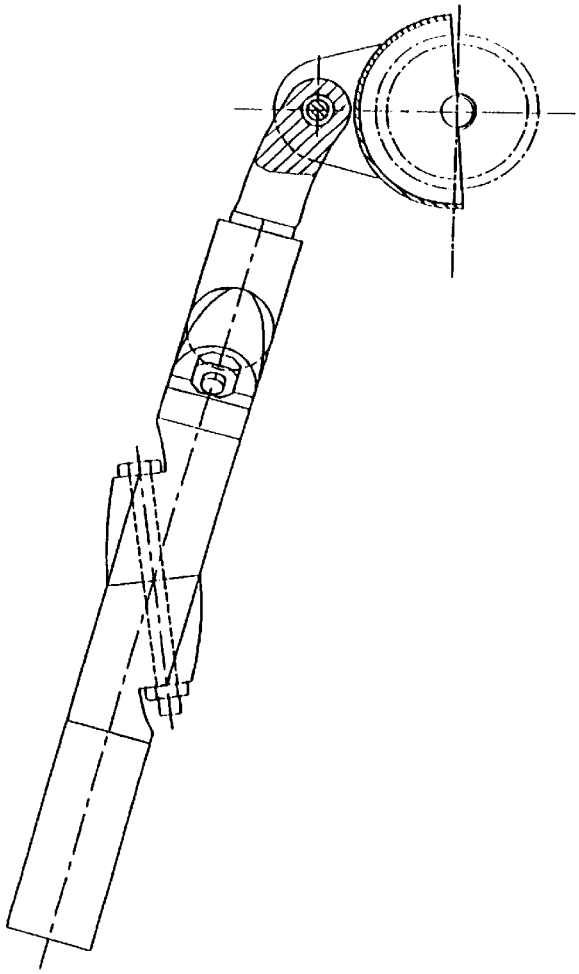

In the above-described preferred embodiment of the present invention, the handle member 124 is releasably connected to the casing means 111 through the above-described ears 116, 117, bolt 118 and nut 119. Such a preferred design provides adjustable tilted-angle paint rolling. In addition, the two oblique sections 128, 129 and its associated fastening means (e.g., 132) impart to the roller an added flexibility in adjusting paint rolling direction. Another possible roller handle design is schematically shown in FIG. 4*e* and FIG. 4*f*, in which two separate sets of oblique end sections and their corresponding fastening means co-exist; one set for painting direction adjustment while the other for tilted angle adjustment. Such a three-member handle is similar to that described in FIG. 2*c* and FIG. 2*d*. Such a design makes the shielded roller a much more versatile tool for painting.

In another embodiment, one may choose not to have the tilted angle adjustability by eliminating the ears 116, 117 and the associated bolt 118 and nut 119, but allowing the second handle member 124 to be permanently connected to (or integral with) the casing 111. This will simplify the roller frame design and reduce the manufacturing cost, but will compromise the degree of versatility of the roller.

Still another preferred embodiment of the present invention is related to an improved paint roller extension pole having a pair of oblique sections (FIG. 5). Such a paint roller handle extension rod comprises (1) a first substantially elongated member 150 with its head end being preferably threaded or slightly tapered to be inserted to the end bore of a paint roller handle 152 and with the second end (opposite end) having an oblique section 154 inclined at an angle of approximately 5 to 45 degrees (shown here as 45°) with respect to the longitudinal axis of said first handle member 150, (2) a second substantially elongated member 156 with its proximal end having a similarly shaped oblique section 158, inclined at an approximately identical angle, and (3) a releasable fastening means 160 to tighten the two pole members at the two mating oblique end sections 154, 158. The longitudinal axis of the fastening means (e.g., the bolt of a bolt-nut combination) traverses approximately through the geometric centers of the two oblique sections.

Figure 5A:
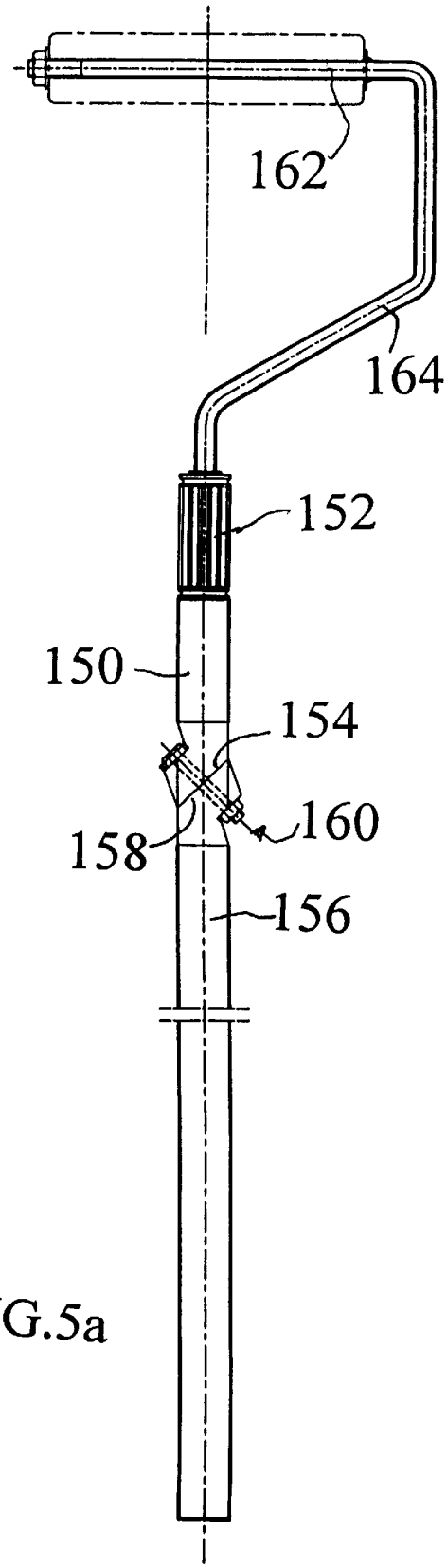
FIG. 5*a* shows the front view while FIG. 5*b* the side view of the roller in its conventional orientation for vertical rolling.
Figure 5B:
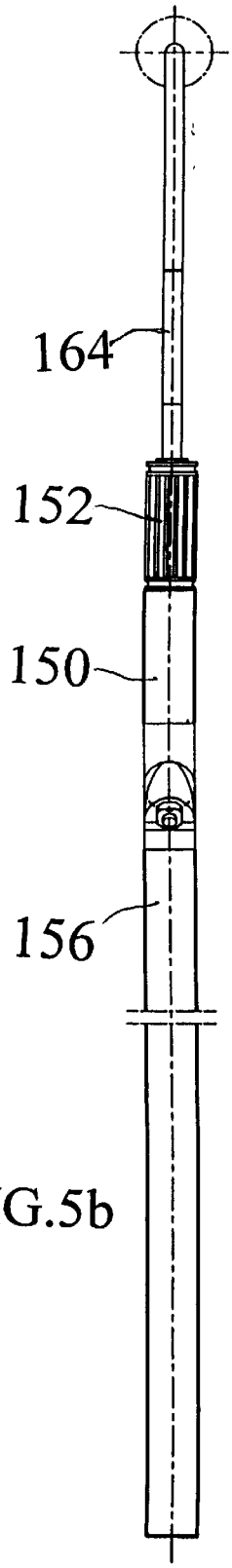
FIG. 5 shows the schematic of an improved extension pole with one set of oblique sections and a releasable fastening means for paint rolling direction adjustments. The normal to the oblique sections lies approximately on the primary plane defined by the roller axle 162, shaft 160, longitudinal axis of handle 152. Such a design permits switching between vertical and horizontal rolling.
FIG. 5*c* shows the front view of the roller in its alternate orientation for horizontal rolling.
Figure 5C:
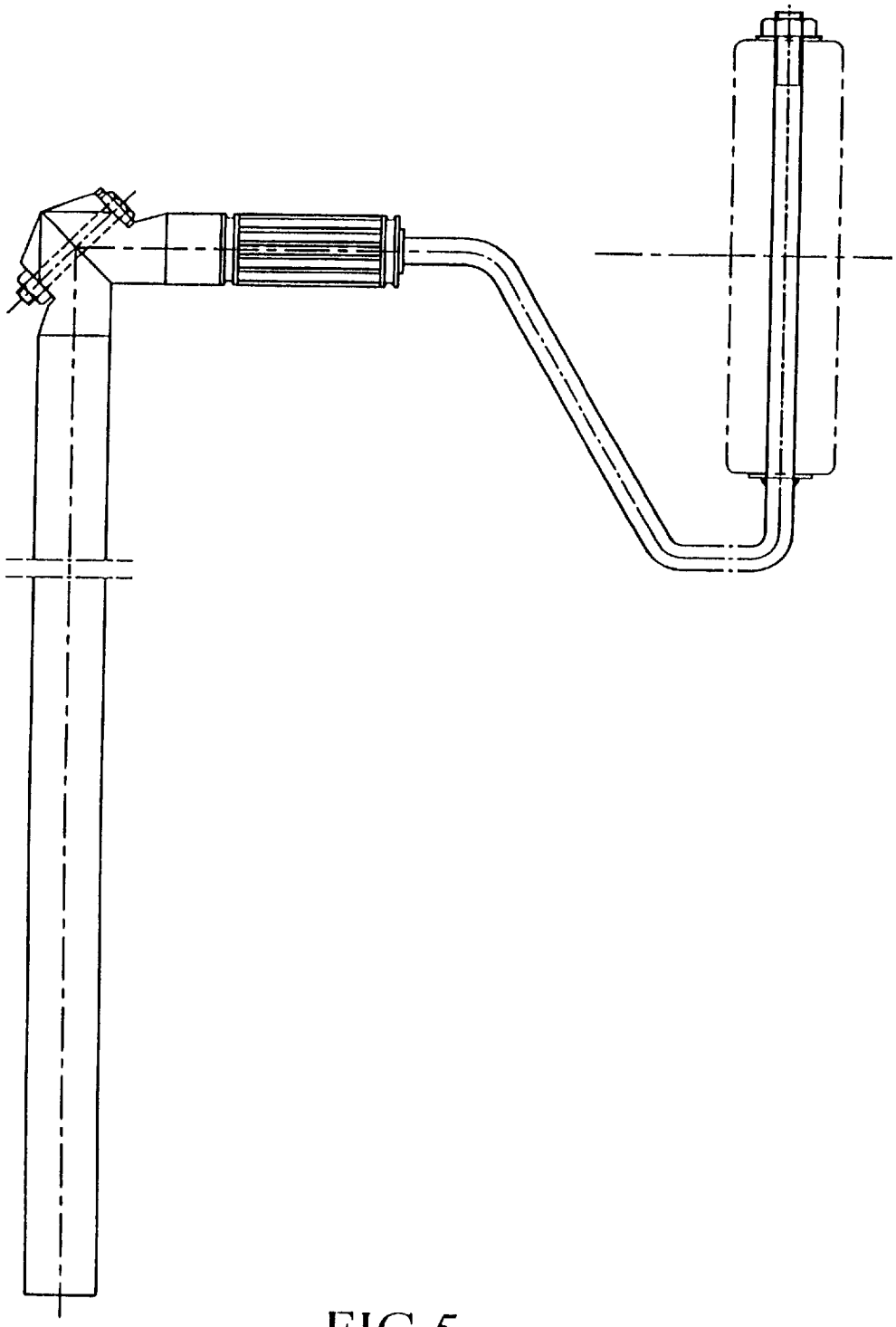
Figure 6A:
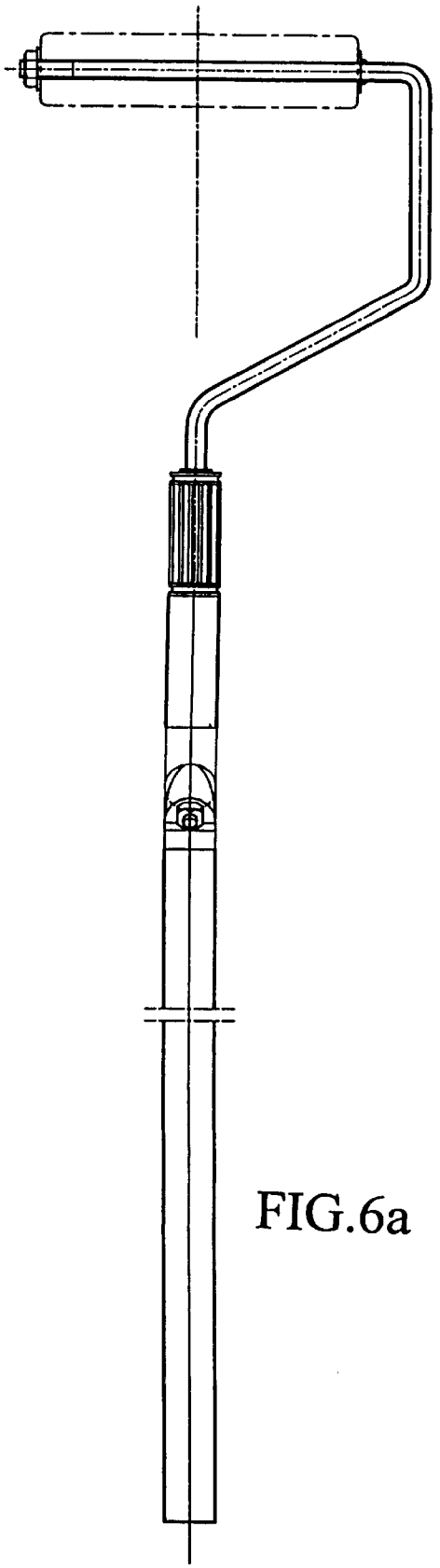
FIG. 6 shows the schematic of an extension pole with one set of oblique planes to which the normal lies off the primary plane by an angle of approximately 45°. This design permits tilting angle adjustments, but does not lend itself for painting direction adjustments.
Figure 6B:
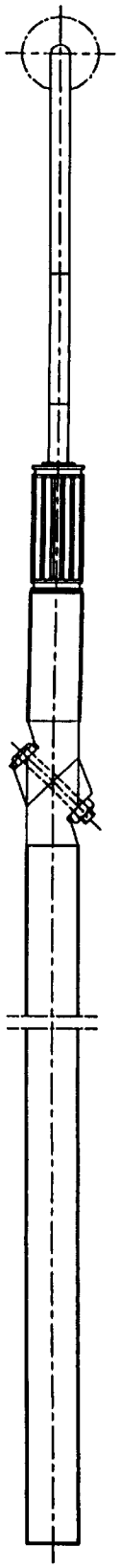

The extension pole shown in FIG. 5*a* and 5*b* is so arranged that the normal to the oblique sectional plane lies substantially on the primary plane defined by the longitudinal axis of the roller handle 152, the shaft 164, and the axle of the roller cage assembly. Such a configuration will permit switching between vertical paint rolling (as shown in FIG. 5*a* or 5*b*) and horizontal rolling (FIG. 5*c*). In contrast, shown in FIG. 6*a* and 6*b* is an extension pole with the set of oblique sectional planes so arranged that their normal lies off the primary plane. Such an arrangement provides switching between regular vertical rolling (FIG. 6*a*) and tilted-angle rolling (similar to the situation in FIG. 3*c*), but not horizontal rolling. If the angle between the normal to the oblique plane and the longitudinal axis of the roller handle were approximately 22.5°, then 45°-tilted angle paint rolling, similar to the situation depicted in FIG. 3*f*, will be possible. The above two examples (FIG. 5 and FIG. 6) demonstrate that, depending on the orientation of the oblique sections with respect to the primary plane, an extension pole in accordance with the present preferred embodiments can provide rolling directional adjustments or tilted angle adjustments. Both types of adjustment can be achieved with one extension pole if it contains both types of oblique planes.

Figure 7:
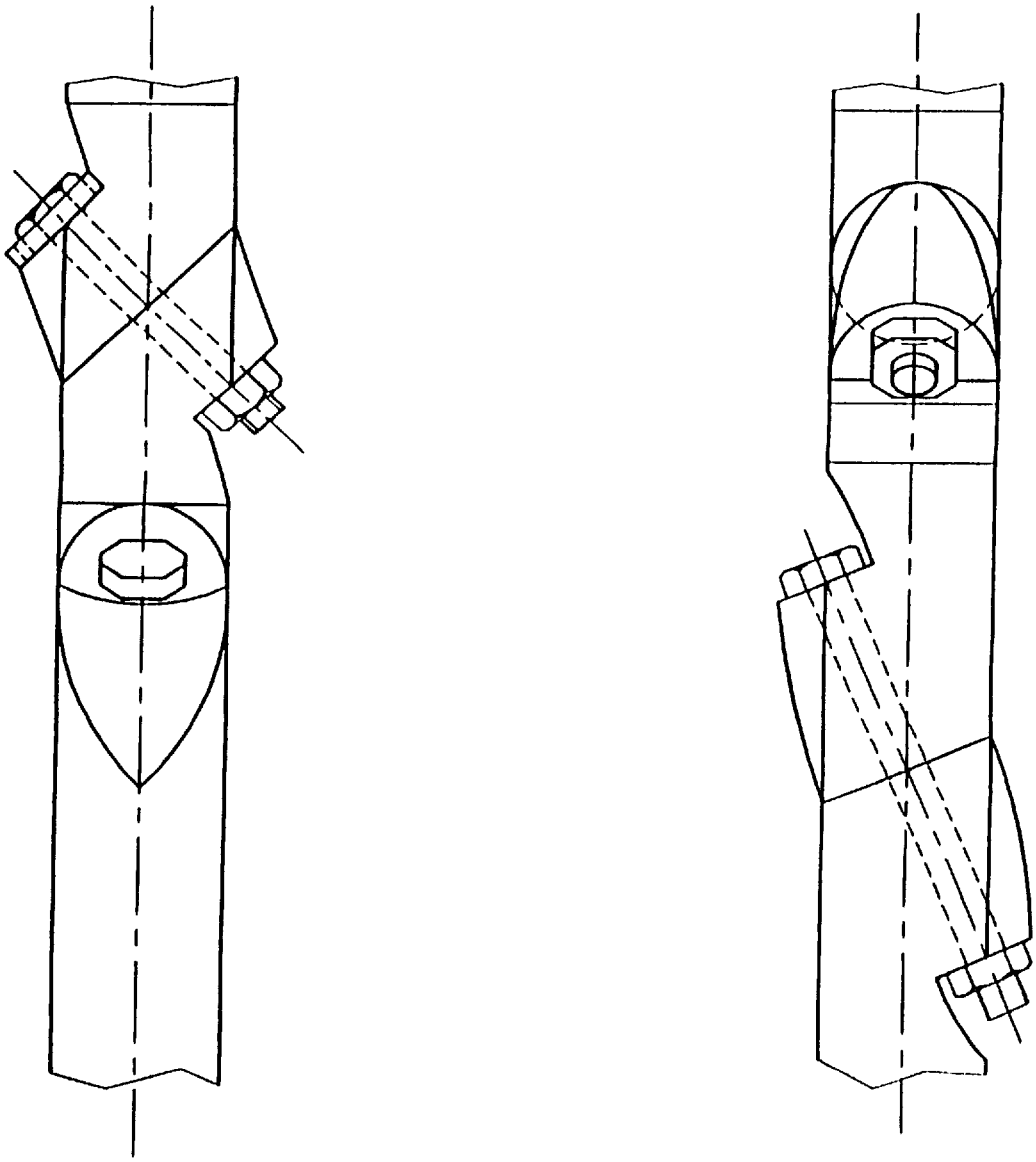
FIG. 7 shows the schematic of an extension pole with two sets of oblique planes that are connected by two releasable fastening means. One set of mating oblique end sections provides added tilted painting angle adjustability while the other set painting direction adjustability.

Hence, still another preferred embodiment of the present invention is related to a paint roller frame containing an extension pole that has two separate sets of oblique end sections (FIG. 7). The two sets are inclined with respect to each other at an angle of approximately 5° to 90°, but preferably at 90°. One set of oblique end sections, to which the normal is inclined at an angle of approximately 5° to 45° with respect to the longitudinal axis of the pole, is used to adjust paint rolling direction between vertical and horizontal rolling. The second set of oblique end sections, to which the normal is inclined at an angle of approximately 5° to 45° with reference to the longitudinal axis of the pole, is used for tilted painting angle adjustments. These two sets of oblique planes therefore should not be parallel to each other. Other features of this extension pole are similar to those of the extension pole with only one set of oblique sections described earlier. The arrangement of these two sets of oblique planes is similar to what is specified in FIG. 2*c* and FIG. 2*d*.

It may be noted that there are an unlimited number of fastening means that can be used to releasably tighten two shaft segments together. Cost considerations suggest that pivot-type fastening means with bolts and nuts are preferred. Further, many types of nuts may be utilized in the pivot, but those that can be tightened with the assistance of a simple tool such as a screw driver and a wrench, or with a bare hand, are preferred. The two mating oblique planes may be made to have one of the many types of surface texture patterns or degrees of surface roughness. Those that impart firmness to avoid skidding or slipping are preferred. Although, as shown in most of the attached figures, off-set platforms are provided for near the oblique sections to better accommodate the nut (e.g. 24) and the knurled portion (e.g. 23) of a bolt, this is not a necessary requirement for the presently invented roller handles or extension poles. The handle or the extension pole may be just a rod of more or less uniform diameter.

The above examples serve only to illustrate the preferred embodiments of the present invention. While the description of these examples contains many specificities, the reader should not construe these as limitations on the scope of the invention, but merely as exemplifications of preferred embodiments thereof. Those skilled in the art will envision many other possible variations are within its scope. For instance, in each discussed case, the location of oblique sections can be varied along the roller frame or extension pole. Further, there are many other mechanisms with which one can lock, catch, fasten, or otherwise tightly or snugly connect different segments of a roller handle together. Certain fastening means may have a quick-disconnect feature that allows an easy snap-on or snap-off. A paint roller frame containing any such mechanism should be considered as a simple variation of the roller frame as specified in the presently stated preferred embodiments.

The above examples also demonstrate the design simplicity and flexibility of the roller frame configuration and, therefore, the ease with which one can manufacture these frames. Yet, this invention makes a paint roller frame or extension pole so much more versatile. The frame shafts are preferably made out of plastic or metallic materials or a combination thereof. The main body of a frame shaft may be made of metallic rods. Alternatively, one oblique section could contain an integral bolt to insert into and through the mating hole in the other oblique section, allowing the two handle or pole segments to be releasably fastened together by a nut. Casting, transfer molding, or injection molding may also be used to fabricate an all-plastic frame configuration. The parts in a pivot or other fastening mechanism such as bolts, pins, nuts, and screws may be made from plastics, but are preferably made of metals such as steel or aluminum alloy.

We claim:

1. A paint roller frame comprising:

a roller cage assembly, a shaft for receiving said roller cage assembly, and a handle for supporting said shaft; said handle comprising two substantially elongated handle members, herein referred to as the first handle member and the second handle member, respectively:

a. said first handle member having two ends: the first end and the second end; the first end being connected to or integral with said shaft while the second end having an oblique end section to which the geometric normal being inclined with respect to the longitudinal axis of said first handle member at an angle of approximately 5 to 45 degrees, b. said second handle member having two ends: the proximal end and the distal end; the proximal end having an oblique end section being similar in shape and inclination angle to the second end section of said first handle member; the two similarly shaped and inclined end sections forming a pair of mating oblique end sections which are connected by a releasable fastening means; the distal end of said second handle member optionally having a substantially elongated bore to accommodate an extension pole.

2. A paint roller frame as in claim 1, wherein said first handle member has an oblique end section to which the geometric normal being inclined with respect to the longitudinal axis of said first handle member at an angle of approximately 22.5 degrees to permit switching between normal 0-degree and tilted 45-degree paint rolling.

3. A paint roller frame as in claim 1, wherein said first handle member has an oblique end section to which the normal being inclined with respect to the longitudinal axis of said first handle member at an angle of approximately 22.5 to 45 degrees and lying substantially in the geometry plane constituted by the axle of said roller cage assembly and the longitudinal axis of said first handle member to permit switching between vertical and horizontal paint rolling.

4. A paint roller frame as in claim 1, said handle comprising three substantially elongated handle members, herein referred to as the first handle member, the second handle member, and the third handle member, respectively:

a. said first handle member having two ends: the first end and the second end; the first end being connected to or integral with said shaft while the second end having an oblique end section to which the geometric normal being inclined with respect to the longitudinal axis of said first handle member at an angle of approximately 5 to 45 degrees;

b. said second handle member having two ends: the proximal end and the distal end; the proximal end having an oblique end section being similar in shape and inclination angle to the second end section of said first handle member; the two similarly shaped and inclined end sections forming a first pair of mating oblique end sections which are connected by a first releasable fastening means; the distal end of said second handle member having an oblique end section to which the geometric normal being inclined with respect to the longitudinal axis of said second handle member at an angle of approximately 5 to 45 degrees;

c. said third handle member having two ends: the adjacent end and the opposite end; the adjacent end of said third handle member having an oblique end section which is similar in shape and inclination angle to the corresponding oblique end section at said distal end of said second handle member; these two similarly shaped oblique end sections forming a second pair of mating oblique end sections; said first pair and said second pair of oblique end sections being mutually inclined at an angle of approximately 45 to 90 degrees whereby one pair can be used for adjusting the tilted painting angle while the other pair for adjusting the paint rolling direction; the opposite end of said third handle member optionally having a substantially elongated bore to accommodate an extension pole.

5. A shielded paint roller frame comprising, in combination, a roller cage assembly containing a spray shield casing, and a handle comprising two substantially elongated members, referred to as the first handle member and the second handle member, respectively:

a. said first handle member being adjacent to said spray shield casing; the proximal end of said first handle member being connected to, through a coupling means, or integral with said spray shield casing; the distal end of said first handle member having an oblique end section to which the normal being inclined with respect to the longitudinal axis of said first handle member at an angle of approximately 5 to 45 degrees;

b. said second handle member having a proximal end with an oblique section that is similar in shape and inclination angle to the corresponding oblique section at said distal end of said first handle member; the free end of said second handle member optionally having a substantially elongated bore to accommodate an extension pole; said two handle members being connected by a releasable fastening means.

6. A paint roller frame as in claim 5, wherein said first handle member has an oblique end section to which the normal being inclined with respect to the longitudinal axis of said first handle member at an angle of approximately 22.5 degrees to permit switching between the straight 0-degree and 45°-tilted paint rolling.

7. A paint roller frame as in claim 5, wherein said first handle member has an oblique end section to which the normal being inclined with respect to the longitudinal axis of said first handle member at an angle of approximately from 22.5 to 45 degrees and lying approximately in the geometry plane defined by the longitudinal axis of said first handle member and the longitudinal ridge line of said spray shield casing which is parallel to the axle of said roller cage assembly; said two oblique end sections are releasably fastened with a fastening means to permit switching between vertical and horizontal paint rolling.

8. A paint roller handle extension pole comprising two substantially elongated members: the first elongated member and the second elongated member, respectively;

a. said first elongated member having one end being threaded or slightly tapered so that this end can be inserted into the corresponding end bore of a commonly used paint roller handle; the opposite end of said first elongated member having an oblique end section inclined at an angle of approximately 5 to 45 degrees with respect to the longitudinal axis of said first elongated member, b. said second elongated member with its proximal end having an oblique end section being similar in shape and inclination angle to the corresponding oblique end section of said first elongated member, the oblique end section of said first elongated member and the corresponding oblique end section at said proximal end of said second elongated member forming a pair of mating oblique end sections that are connected by a releasable fastening means; the longitudinal axis of said fastening means traverses approximately through the geometric center of said pair of oblique end sections.

9. A paint roller extension pole as in claim 8, but has a third substantially elongated member, wherein the distal end of said second elongated member having an oblique end section inclined at an angle of approximately 5 to 45 degrees with respect to the longitudinal axis of said second elongated member; the proximal end of said third elongated member having a corresponding oblique end section of approximately similar shape and at a similar inclination angle; said second elongated member being releasably connected through a second releasable fastening means to said third elongated member; the pair of mating oblique end sections of said first and second elongated members being inclined at an angle of approximately 45 to 90 degrees with respect to the pair of mating oblique end sections of said second and third elongated members, whereby one pair of mating oblique end sections can be used for adjusting tilted painting angles while the other pair for adjusting paint rolling directions.

* * * * *